United States Patent [19]

Bayer

[11] 3,990,482

[45] Nov. 9, 1976

[54] LOOP PICKER

[75] Inventor: Michael L. Bayer, Mansfield, Ohio

[73] Assignee: The Terrell Machine Company, Charlotte, N.C.

[22] Filed: June 9, 1975

[21] Appl. No.: 584,866

[52] U.S. Cl. ..... 139/159

[51] Int. Cl.[2] ..... D03D 49/36

[58] Field of Search ..... 139/159, 160 R

[56] References Cited

UNITED STATES PATENTS

| | | | |
|---|---|---|---|
| 2,032,734 | 3/1936 | Bacon | 139/159 |
| 2,564,424 | 8/1951 | Chadbourne | 139/160 R |
| 2,585,435 | 2/1952 | Chadbourne | 139/160 R |
| 3,332,450 | 7/1967 | Bowling et al. | 139/159 |
| 3,605,820 | 9/1971 | Campbell | 139/159 |
| 3,608,588 | 9/1971 | Brown | 139/159 |

FOREIGN PATENTS OR APPLICATIONS

| | | | |
|---|---|---|---|
| 708,122 | 4/1954 | United Kingdom | 139/159 |
| 293,073 | 1/1971 | U.S.S.R. | 139/159 |

*Primary Examiner*—James Kee Chi

*Attorney, Agent, or Firm*—Richards, Shefte & Pinckney

[57] ABSTRACT

The picker stick holding grip of a loop picker is significantly increased, and overall picker performance is materially improved through superior wear characteristics, by interposing a layer of thermoplastic material (e.g., nylon fabric) in the course of building the picker body by wrapping layers of rubberized fabric about picker loop and face block portions in preparation for molding the same during a vulcanizing cure.

2 Claims, 5 Drawing Figures

LOOP PICKER

CROSS REFERENCES TO RELATED APPLICATIONS

None; although an improvement is presently disclosed of the loop picker described and claimed in U.S. Pat. No. 3,605,820, which is of related interest for that reason.

BACKGROUND OF THE INVENTION

A loop picker is mounted on a picker stick to throw and receive the impact of the shuttle during loom operation. A common form is built by assembling rubberized fabric layers to provide an uncured oversize blank of the general shape desired and then subjecting this blank to a vulcanizing cure under molding pressure to size the final picker body with the outward appearance of being solid. U.S. Pat. No. 2,032,734, for example, illustrates and describes the formation of such a picker.

In order to provide for picker stick mounting, the picker body is conventionally formed with a hole or loop that is sized for installation on the upper end of the picker stick, which is characteristically tapered. According to usual practice, the picker loop is undersized from front to back, in the order of 1/16 inch, so that the picker body will encounter some resistance on the picker stick taper requiring it to be pressed into place and allowing it to be aligned readily at the shuttle level.

With picker bodies of this sort as heretofore available, however, the allowable undersizing of the loop for the foregoing purpose was not sufficient to hold the picker in place during use, so that application of glue between the picker and stick or insertion of a fastening screw was needed to complete the installation. In either event, as the picker will wear and must be replaced a number of times during the life of the stick, the matter of picker replacement was rendered difficult and often resulted in damaging the stick at its upper end taper to such an extent that it would have to be discarded before its useful life was spent.

The above-noted prior U.S. Pat. No. 3,605,820 made it possible to undersize the loop to a greater extent for combatting such difficulties, but the picker stick holding grip obtained from such further undersizing has not heretofore been as great as desirable.

SUMMARY OF THE INVENTION

According to the present invention, a loop picker is provided in which the picker stick holding grip is significantly increased by interposing a layer of thermoplastic material in the course of wrapping the rubberized fabric layers about loop and face block portions to form the body of the picker blank for molding and curing.

The thermoplastic material used for the interposed layer must be sufficiently flexible for handling comparably with the rubberized fabric, and it must have a melting temperature above that employed for the vulcanizing cure. A nylon layer in fabric form is preferred, as will be noted further below, although a flexible film form can also be used and other thermoplastic materials can be employed, such as a terephthalic polyester or an acrylic. In building the picker with this interposed thermoplastic layer a substantially equal weight of the rubberized fabric layering, that would otherwise be used, is eliminated so that the normal bulk or volume of the picker structure is not essentially changed during formation or in finished form.

The picker structure formed in this manner not only allows greater undersizing of the loop for effective picker stick gripping without fastening in any way, but also provides superior wear characteristics at the face block portion by reason of arrangement of the interposed thermoplastic material in building this portion of the picker body as well. The result is due in part, of course, as was true in the case of prior U.S. Pat. No. 3,605,820, to the increased strength or reinforcement imparted by the interposed thermoplastic material, but a more important factor appears to be the increased length of the interposed material in affording greater gripping power at the undersized loop while strengthening the loop sufficiently for greater undersizing as well as improving wear resistance at the face block portion for appreciably better service.

DETAILED DESCRIPTION OF THE INVENTION

Figure 1:
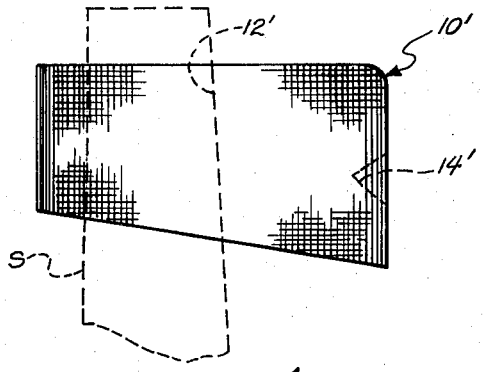
FIG. 1 is a side elevation of a loop picker embodying the present invention in place on a picker stick.
Figure 2:
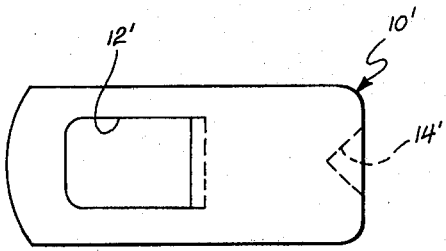
FIG. 2 is a top plan view of the FIG. 1 picker.
Figure 3:
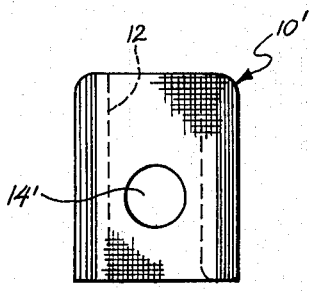
FIG. 3 is a right end view of the FIG. 1 picker.

A loop picker embodying the present invention is shown at 10' in FIG. 1 with its mounted operating disposition indicated in relation to a broken line representation of the upper end tapered portion of a picker stick S. FIGS. 2 and 3 additionally illustrate the form of hole 12' provided in the loop picker 10' for mounting on the stick S, and the front face recess 14' arranged to receive the nose of the shuttle (not shown) in relation to which the picker 10' acts during loom operation.

Figure 4:
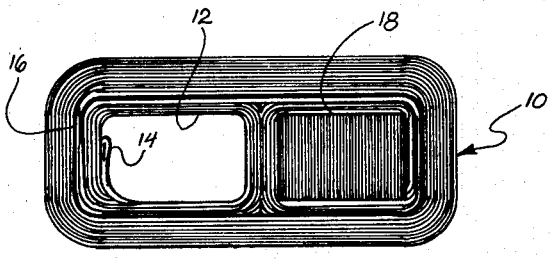
FIG. 4 is a top plan view of an uncured blank for the FIG. 1 picker.
Figure 5:
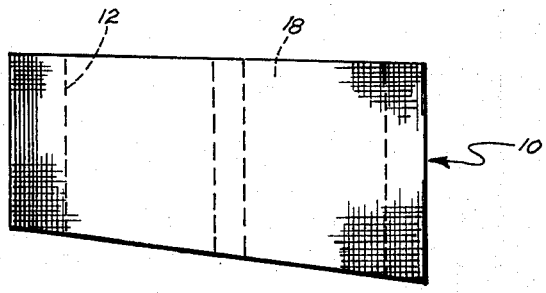
FIG. 5 is a side elevation corresponding to FIG. 4.

FIGS. 4 and 5, in turn, illustrate the type of blank 10 prepared for forming the picker 10'. In general, the blank preparation follows the procedure described in the previously noted U.S. Pat. No. 2,032,734, although in the present instance wrapping of the rubberized fabric starts at the back side of the loop 12 provided for forming the picker stick hole 12' in the finished picker 10'.

A 25% nylon-75% cotton fabric may be suitably employed according to the present invention at a 38 × 38 count of 6½s warp and filling to provide a square yard weight of about 8 or 9 ounces. Any other fabric of equivalent or greater strength may, of course, be used instead. After rubber impregnation, a short length of the fabric is doubled back upon itself to form the starting edge (represented at 14 in FIG. 4) at which wrapping is commenced around a core bar (not shown) to form the loop 12, which starts at the back side of the loop as previously noted.

After wrapping of the rubberized fabric has been continued to superimpose further layers at the loop structure, a face block portion 18 is disposed at the front side of the loop 12 for incorporation in the picker body. This face block portion 18 is provided to receive and bear directly the impact from shuttle contact during operation of the picker, and it is formed of rubberized fabric strips laid up or stacked to build the block core.

Once the face block portion 18 has been formed and is in place, wrapping of the rubberized fabric used initially in forming the loop 12 is continued about the face block portion 18 as well to build the body of the picker blank 10 to a suitable fullness for molding. The supplementary thermoplastic layer that characterizes the present invention is interposed during this continued body-building wrapping to form a differential wrap as indicated at 16 in FIG. 4. It is preferred to interpose the thermoplastic layer 16 about one-third of the way outward from the individually wrapped picker loop and face block portions 12 and 18. For example, if nine wraps are employed in the body building, the thermoplastic layer 16 is interposed as the third wrap is being completed. Such an arrangement appears to increase loop holding power and face block wear resistance at the best advantage.

As noted earlier, the thermoplastic layer or wrap 16 is preferably provided in fabric form. Excellent results have been obtained with a nylon fabric constructed of 840/2 nylon 714 filament having a 12 × 12 twist and employed at a 22 × 22 count to yield a square yard weight of about 12.5 ounces. Any or all of the fabric characteristics can be varied as a matter of choice as long as a square yard weight of 12 ounces or more is maintained. Interposition of the thermoplastic layer 16 is begun to extend across the back side of the loop 12 at the outset and is continued for a complete wrap and overlapping at this back side, so that the result is to interpose the layer 16 over layers of the rubberized fabric directly at three sides of loop 12 at which the picker stick hole 12' is to be formed. This overlapping of the interposed layer end portions at the back side of loop 12 results in building up the picker wall thickness in back of the picker stick hold 12', as is usually done by back-lapping rubberized fabric layering at this point and which can be dispensed with together with enough of the rubberized layering otherwise to maintain a substantially equal weight or bulk in the picker structure as previously mentioned.

Before commencing the body-building wrapping it may be desirable, although not essential to place filler bead elements at each base corner of face block portion 18 as proposed in the earlier noted U.S. Pat. No. 2,032,734. If used, such bead elements are satisfactorily formed of cotton cord having a sufficient filler size.

Building of the picker blanks 10 in the foregoing manner is done in a composite length extending perpendicular to the plane of FIG. 4 that corresponds to a standard fabric width (e.g., 60 inches), and the individual blanks 10 are cut from this composite length to a form such as is illustrated in FIG. 5 in which the vertical blank height will correspond essentially with that desired in the finished picker 10', while the outer transverse dimensions of the blank 10 will be somewhat oversize for molding to the finished size and shape of picker 10' during a vulcanizing cure.

For this finishing step, the cut blanks 10 are placed in individual mold cavities in which a core of picker stick shape is provided to form the tapered mounting hole 12', and a projection is arranged to form the shuttle nose recess 14'. The molding is done under pressure of about 100 p.s.i., at a temperature around 300° F., and is continued for approximately 18 minutes to effect the vulcanizing cure as the final picker shape is obtained.

The resulting loop picker 10' will mount on picker sticks S measuring more from front to back than the picker stick hole 12' without any adverse effect on the picker structure, and when so mounted will grip the picker stick firmly enough to maintain operating alignment simply from having been pressed into place. And, as the need for auxiliary fastening is thereby eliminated, the loop pickers 10' may also be pressed out of place for replacement just as readily as they are mounted, so that commonly resulting picker stick damage or marring during picker installation and removal is avoided.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. An improved loop picker for looms of the type formed by molding assembled layers of rubberized fabric during a vulcanizing cure and having the body of said loop picker built by wrapping a plurality of said rubberized fabric layers about individually wrapped picker loop and face block portions, in which a layer of nylon fabric formed of filament having a twist in the order of 12 × 12 and providing a square yard weight of at least 12 ounces and having a melting temperature above the temperature employed for the vulcanizing cure is interposed in said body building rubberized fabric layers.

2. An improved loop picker as defined in claim 1 wherein said nylon fabric layer is interposed in the body of said loop picker about one-third of the extent of said body outward from said individually wrapped picker loop and face block portions.

* * * * *